United States Patent [19]

Rasmussen

[11] 4,044,678

[45] Aug. 30, 1977

[54] PRINTING CYLINDER FOR PRINTING MACHINES

[75] Inventor: Claus Løwe Rasmussen, Horsens, Denmark

[73] Assignee: Schublich A/S, Denmark

[21] Appl. No.: 703,209

[22] Filed: July 7, 1976

[30] Foreign Application Priority Data

July 14, 1975 Denmark ..... 3199/75

[51] Int. Cl.[2] ..... B41F 27/10

[52] U.S. Cl. ..... 101/378; 101/153

[58] Field of Search ..... 101/375, 376, 378, 153; 29/123, 125, 129.5

[56] References Cited

U.S. PATENT DOCUMENTS

| | | | |
|---|---|---|---|
| 1,891,405 | 12/1932 | Ericksson | 101/375 |
| 2,587,606 | 3/1952 | Dungler | 101/375 X |
| 3,739,722 | 6/1973 | Zottoli | 29/125 X |

FOREIGN PATENT DOCUMENTS

| | | | |
|---|---|---|---|
| 2,310,987 | 3/1973 | Germany | 101/375 |

*Primary Examiner*—J. Reed Fisher

*Attorney, Agent, or Firm*—Bucknam and Archer

[57] ABSTRACT

A printing cylinder for printing machines comprising a shaft, a sleeve adapted to support a printing block and mounted on the shaft with radial clearance, and an adjusting mechanism provided at each end of the sleeve. Each adjusting mechanism comprises a guide ring and a clamping ring having cooperating conical guide surfaces. A fit between the shaft and the guide ring is so easy that the guide ring may be somewhat tilted relative to a plane at right angles to the longitudinal axis of the shaft, and the clamping ring comprises radial, adjustable securing means and axial adjusting means, whereby it is possible to center the sleeve very precisely relative to the shaft.

10 Claims, 4 Drawing Figures

PRINTING CYLINDER FOR PRINTING MACHINES

Figure 1:
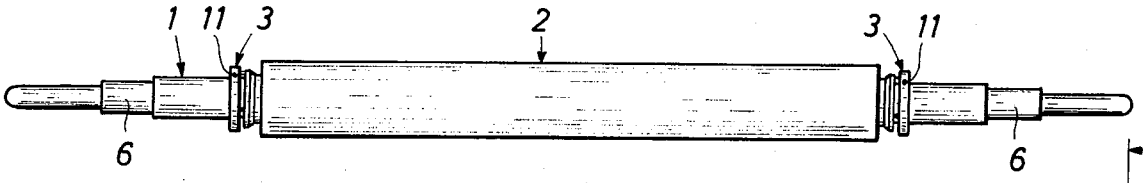

The present invention relates to a printing cylinder for printing machines, particularly flexoprinting machines and indirect photogravure printing machines, comprising a shaft, a sleeve adapted to support a printing block and mounted on the shaft with radial clearance, and two adjusting mechanisms, i.e. a respective mechanism provided at each end of said sleeve, each adjusting mechanism being adapted to centre and secure the sleeve on the shaft, and each comprising a guide ring and a clamping ring, said guide ring being provided with a circumferential conical guide surface engageable with a corresponding circumferential conical guide surface at each end of the sleeve.

U.S. patent No. 3,739,722 discloses a printing cylinder of the type as stated in the opening paragraph. In addition to a guide ring and a clamping ring in the form of a lock nut each adjusting mechanism is provided with a spacer ring between the guide ring and the lock nut. The shaft is provided with a thread at each end. When the lock nut is screwed on the thread, it will bear against the spacer ring and consequently against the guide ring, whereby the guide ring will centre the sleeve relative to the shaft in consequence of engagement between the circumferential conical guide surface of the guide ring and the circumferential conical guide surface at the end of the sleeve in question. Since the guide ring is provided with longitudinal slots, it will be clamped about the shaft. The printing cylinder, however, does not permit a succeeding fine adjustment of the position of the sleeve relative to the shaft in order to obtain a very accurate centering of the sleeve on the shaft.

Danish patent specification No. 127,277 furthermore discloses a printing cylinder comprising a shaft, a sleeve mounted on the shaft with clearance, and two adjusting mechanisms, i.e. a respective adjusting mechanism provided at each end of the sleeve. Each adjusting mechanism is adapted to centre and secure the sleeve to the shaft. Each adjusting mechanism consists of three radial adjusting screws arranged at each end of the sleeve. This printing cylinder, however, requires rather long time to centre the sleeve relative to the shaft by means of these three adjusting screws when the sleeve has been located on the shaft. It takes often 10 to 15 minutes and is difficult work demanding much routine.

The object of the invention is to provide a printing cylinder of the type as stated in the opening paragraph permitting a fine adjustment of the position of the sleeve relative to the shaft, thus rendering it possible to centre the sleeve very precisely relative to the shaft considerably quicker than by the known printing cylinders.

The printing cylinder according to the invention is characterized in that a fit between the shaft and the guide ring is so easy that the guide ring may be somewhat tilted relative to a plane at right angles to the longitudinal axis of the shaft, and that the clamping ring comprises radial, adjustable securing means and axial adjusting means. By means of these two adjusting mechanisms a sleeve may be mounted on the shaft by placing a clamping ring on the shaft, and then locking this clamping ring by tightening the radial securing means of the clamping ring. Subsequently a guide ring is placed on the shaft in such manner that the guide ring bears against the clamping ring, and the sleeve is then placed on the shaft in such manner that it bears against the guide ring. In this manner the conical guide surface of the guide ring is brought into engagement with the conical guide surface at the end of the sleeve in question, whereby a precentering is achieved, i.e. a coarse centering of the end of the sleeve relative to the shaft since the guide ring is substantially concentric relative to the shaft. A second guide ring is then placed at the second end of the shaft, and this second guide ring is displaced till it bears against the second end of the sleeve. This provides also a precentering of the second end of the sleeve. Finally a second clamping ring is placed on the shaft in such manner that it bears against the second guide ring, and the clamping ring is locked. Subsequently, the sleeve is fine adjusted relative to the shaft by means of the axial adjusting means of the clamping ring, since these adjusting means by a suitable adjustment may cause the guide rings to take up a slightly inclined position relative to a plane at right angles to the longitudinal axis of the shaft due to the easy fit between the shaft and the guide ring. When the guide ring is in an inclined position the conical guide surface at the end of the sleeve in question will get somewhat displaced relative to the conical guide surface of the guide ring, thus permitting a centering of the sleeve relative to the shaft with an accuracy of less than 0.02 mm. This accuracy is necessary when the printing cylinder is to produce clean-cut imprints. Since it only takes about 5 minutes to perform the precentering and the succeeding fine adjustment, it is possible to perform the centering of the sleeve relative to the shaft substantially quicker than by the known printing cylinders.

According to the invention the sleeve may on its inside at each end be provided with a circumferential cylindrical recess, such as a shoulder, bordering on the conical guide surface of the sleeve, and which is adapted - by an easy fit - to cooperate with a cylindrical guide surface shorter relative to the recess, said cylindrical guide surface being situated on the outside of the tapered end of the guide ring. A preliminary precentering of the sleeve relative to the shaft is obtained, since the cylindrical guide surface of each guide ring will engage with the associated cylindrical recess at the end of the sleeve, when the guide ring is placed at the end of the sleeve during the mounting of the sleeve to the shaft. When the guide rings subsequently are moved right to the ends of the sleeve, the conical guide surfaces of the sleeve and of the guide rings will engage with each other, thus providing a further precentering. This precentering implies that the sleeve will be centred with a relative high accuracy, i.e. about 0.02 to 0.10 mm. The succeeding fine adjustment by means of the axial adjusting means of the clamping rings may easily be performed due to this relatively accurate precentering, and it is thus possible to perform the centering of the sleeve relative to the shaft in particularly short time, i.e. in less than about 5 minutes.

A preferred embodiment of the inventive printing cylinder is that the conical guide surface of each guide ring forms an angle of about 20° to 60°, especially 25°, with the longitudinal axis of the guide ring, and that the conical guide surface at each end of the sleeve also forms an angle of about 20° to 60°, especially 25°, with the longitudinal axis of the sleeve.

Furthermore according to the invention the fit between the shaft and each guide ring may be a clearance fit. This provides a suitable clearance between the shaft and the guide ring, thus permitting an inclined positioning of the guide ring in a suitable angle (about 0° to 3°)

relative to a plane at right angles to the longitudinal axis of the shaft.

Moreover the number of axial adjusting means of each clamping ring may according to the invention be an uneven number. In this manner it is rendered possible to perform particularly quick the fine adjustment of the sleeve relative to the shaft.

The axial adjusting means may further according to the invention be adjusting screws adjustably screwed into threaded holes, said holes extending axially through the clamping ring with a preferably equal angular displacement, e.g. 120°, relative to each other along the periphery of the clamping ring, when three adjusting screws are used. In this manner an inexpensive and simple adjusting mechanism is achieved which, particularly when utilizing three adjusting screws, is capable of an accurate fine adjustment of the sleeve relative to the shaft.

According to the invention each adjusting screw may at its threaded end be provided with a rounded end portion of relatively soft material, e.g. brazen material. In this manner the threaded ends of the adjusting screws will not cause burrs or scratches when they bear against the end surface of the guide ring, said end surface being situated at the non-tapered end of the guide ring.

The radial securing means of the clamping ring may furthermore according to the invention be clamping screws disposed in a plane at right angles to the longitudinal axis of the clamping ring and adjustably screwed into threaded holes, said holes extending radially through the clamping ring with a displacement of about 50° to 70°, especially 60°, relative to each other along the periphery of said clamping ring, when two clamping screws are used. This provides an inexpensive and simple clamping ring which, when utilizing two clamping screws, provides contact between the shaft and each clamping ring on three spots, i.e. at the threaded ends of the two clamping screws and along a line diametrically opposite the clamping screws. Thus a safe and quick locking of each clamping ring on the shaft is achieved and consequently a safe mounting of the sleeve on the shaft.

Moreover each radial threaded hole on the inside of the clamping ring may according to the invention be provided with an axial recess in which a thrust pad is arranged. Since the threaded ends of the clamping screws do not contact the surface of the shaft directly, the threaded ends of the clamping screws will not cause burrs or similar scratches in the surface of the shaft. The thrust pads further provide a larger contact surface between the shaft and each clamping ring.

Finally according to the invention the sleeve may comprise an inner tubular cylinder of metal, especially steel, and an outer tubular cylinder of plastics, especially polyurethane or similar foamed material, said outer tubular cylinder being situated on the outside of the inner tubular cylinder. In this manner the conical and cylindrical guide surfaces of the sleeve may be formed at the ends of the inner tubular cylinder of metal, and thus the guide surfaces will possess the hardness required. Since the outer tubular cylinder is made of plastics the total weight of the sleeve will be reduced at the same time as the outer tubular cylinder will damp vibrations.

Figure 2:
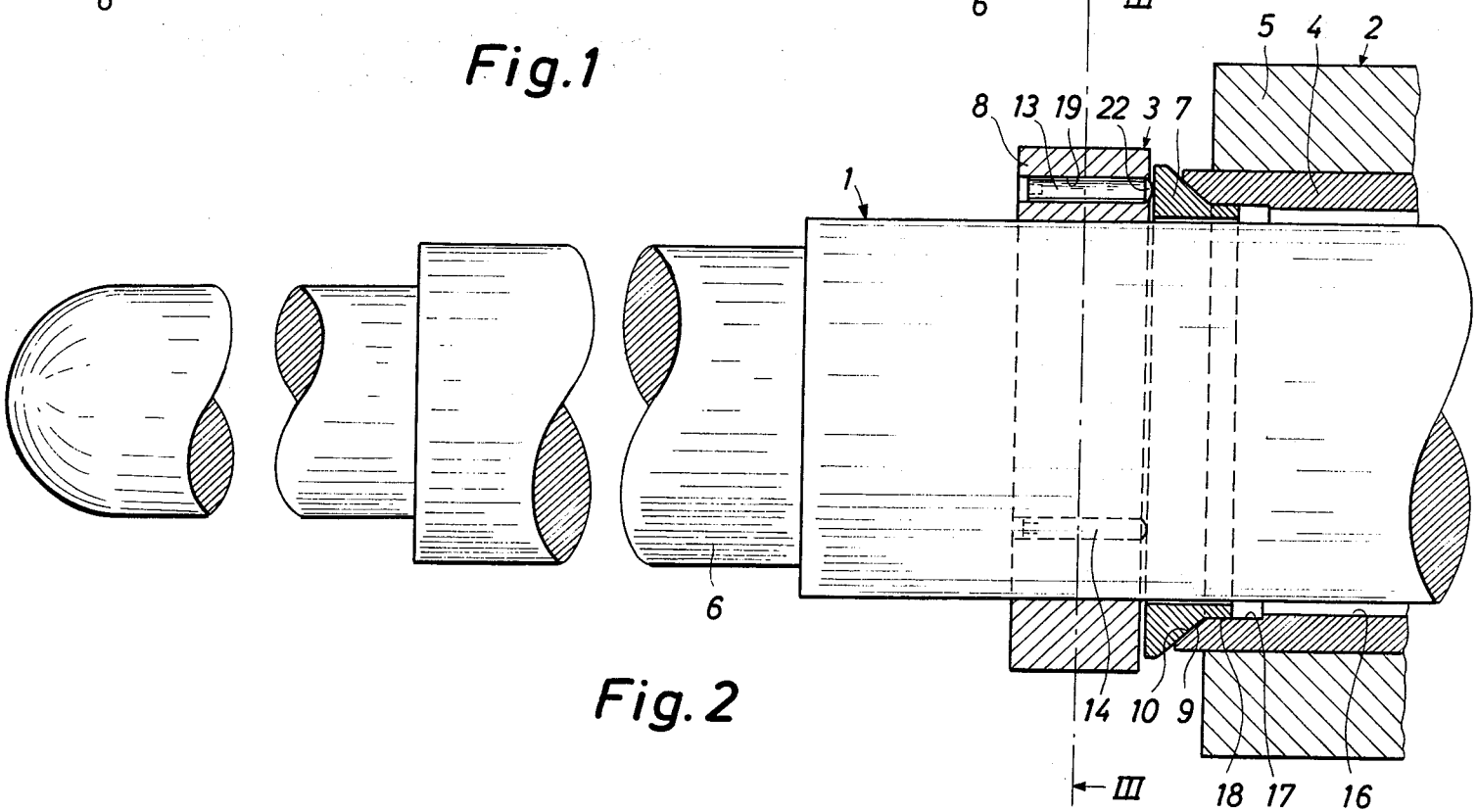
Figure 3:
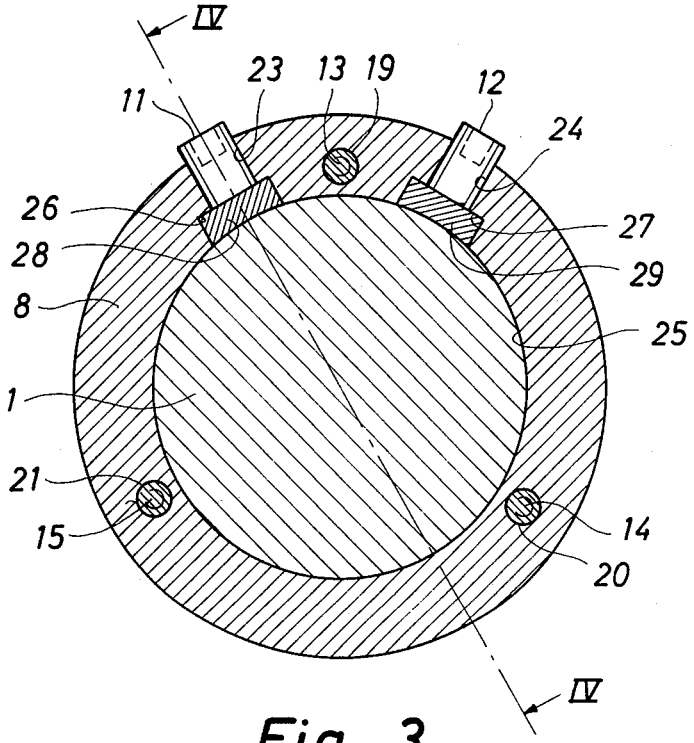
Figure 4:
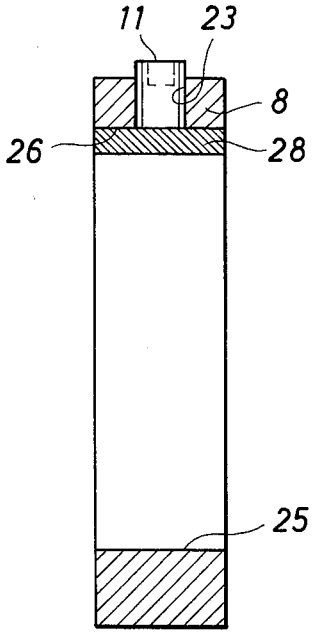

The invention will be described below with reference to the accompanying drawings, in which FIG. 1 is a side view of an embodiment of the printing cylinder according to the invention, FIG. 2 is on a larger scale a vertical longitudinal view through the left end of the printing cylinder in FIG. 1, FIG. 3 is a vertical sectional view through the printing cylinder taken along the line III—III of FIG. 2, and FIG. 4 is a longitudinal view through one of the clamping rings with a clamping screw and a thrust pad taken along the line IV—IV of FIG. 3.

The printing cylinder illustrated in FIG. 1 comprises a shaft 1, a sleeve 2, which is mounted on the shaft 1 with clearance, and an adjusting mechanism 3 arranged at each end of the sleeve 2. The two adjusting mechanisms 3 are adapted to centre and secure the sleeve 2 on the shaft 1. A printing block (not shown) may be secured to the outside of the sleeve 2.

As indicated in FIG. 2 the sleeve 2 comprises an inner tubular cylinder 4 and an outer tubular cylinder 5 situated on the outside of the inner tubular cylinder 4. The sleeve 2 is mounted with such a clearance on the shaft 1 that the middle portion of the shaft 1 cannot contact the inside of the sleeve 2, i.e. the inside of the inner tubular cylinder 4, during rotation. The shaft 1 comprises a cylindrical portion 6 at both ends, and these portions are supported in bearings in the printing machine.

Each adjusting mechanism 3 comprises a guide ring 7 and a clamping ring 8. The guide ring 7 is provided with a circumferential conical guide surface 9 engageable with a corresponding circumferential conical guide surface 10 formed at each end of the sleeve 2. A fit between the shaft 1 and the guide ring 7 is so easy that the guide ring 7 may be somewhat inclined or tilted relative to a plane at right angles to the longitudinal axis of the shaft 1. The clamping ring 8 comprises radial, adjustable securing means in the form of clamping screws 11 and 12 (cf. FIG. 3), e.g. pointed screws, and axial adjusting means in the form of adjusting screws 13, 14, and 15, e.g. pointed screws.

The mounting of a sleeve 2 on the shaft 1 is performed by means of two adjusting mechanisms 3. A clamping ring 8 is first placed on the shaft 1 and then secured by locking its radial clamping screws 11 and 12. Then a guide ring 7 is placed on the shaft 1 so that it bears against the clamping ring 8, and the sleeve 2 is subsequently placed on the shaft 1 in such manner that it bears against the guide ring 7. In this manner the conical guide surface 9 of the guide ring 7 is brought in engagement with the conical guide surface 10 at the end of the sleeve 2 in question. This provides a precentering, i.e. a coarse centering of the end of the sleeve 2 relative to the shaft 1, since the guide ring 7 is substantially concentric relative to the shaft 1. A second guide ring is then placed at the second end of the shaft, and this second guide ring is displaced till it bears against the end of the sleeve 2 in question. This provides a further precentering of the second end of the sleeve 2. Finally a second clamping ring is placed on the shaft 1 in such manner that it bears against the second guide ring, and the clamping ring is locked. Subsequently, the sleeve 2 is fine adjusted relative to the shaft 1 by means of the axial adjusting means 13, 14, and 15 of the clamping rings 7, since these adjusting means by a suitable adjustment may cause that the guide rings 7 take up a slightly inclined position relative to a plane at right angles to the longitudinal axis of the shaft 1 due to the easy fit between the shaft 1 and the guide ring 7. When the guide ring 7 is in an inclined position the conical guide surface 9 at the end of the sleeve 2 in question will get somewhat displaced relative to the conical guide surface 9 of the guide ring 7, thus permitting a centering of the sleeve 2 relative to the shaft 1 with an accuracy of less than 0.02 mm. This accuracy is necessary when the printing cylinder is to produce clean-cut imprints. Since it only takes about 5 minutes to perform the precentering and the succeeding fine adjustment, it is possible to perform the centering of the sleeve 2 relative to the shaft 1 substantially quicker than by the known printing cylinders.

The sleeve 2 is on its inside (FIG. 2) at each end provided with a circumferential cylindrical recess 17, such as a shoulder, which borders on the conical guide surface 10 of the sleeve 2, and which by an easy fit may cooperate with a cylindrical guide surface 18 shorter relative to the recess 17, said cylindrical guide surface 18 being situated on the outside of the tapered end of the guide ring 7. A preliminary precentering of the sleeve 2 relative to the shaft 1 is obtained since the cylindrical guide surface 18 of each guide ring 7 will engage with the associated cylindrical recess 17 at the end of the sleeve 2 when the guide ring 7 is placed at the end of the sleeve 2 during the mounting of the sleeve 2 to the shaft 1. When the guide rings 7 subsequently are moved right to the ends of the sleeve 2, the conical guide surfaces 10 and 9 respectively of the sleeve 2 and of the guide rings 7 will engage with each other, thus providing a further precentering. This precentering implies that the sleeve 2 will be centred with a relatively high accuracy, i.e. about 0.02 to 0.10 mm. The succeeding fine adjustment by means of the axial adjusting means 13, 14, and 15 of the clamping rings 8 may easily be performed due to this relatively accurate precentering, and it is thus possible to perform the centering of the sleeve 2 relative to the shaft 1 in particularly short time, i.e. in less than about 5 minutes.

The fit between the shaft 1 and each guide ring 7 is a clearance fit. This provides a suitable clearance between the shaft 1 and each guide ring 7. FIG. 2 illustrates this clearance on a large scale for the sake of clearness. This clearance renders it possible to position the guide ring 7 inclined in a suitable angle, e.g. about 0° to 3°, relative to a plane at right angles to the longitudinal axis of the shaft 1.

The number of axial adjusting means of each clamping ring 8 in the form of adjusting screws 13, 14, and 15 is preferably an uneven number. This renders it possible to fine adjust the sleeve 2 relative to the shaft 1 particularly quickly.

As illustrated in FIGS. 2 and 3 the axial adjusting screws 13, 14, and 15 are adjustably screwed into threaded holes 19, 20, and 21. These threaded holes 19, 20, and 21 extend axially through the clamping ring 8 with a preferably equal angular displacement, e.g. 120°, relative to each other along the periphery of the shaft 1 (FIG. 3), when three adjusting screws are used, as also illustrated by the embodiment of FIGS. 2 and 3. This provides an inexpensive and simple adjusting mechanism which, in a very simple manner, may fine adjust the sleeve 2 relative to the shaft 1 by means of three adjusting screws. In the first place the adjusting screws 13, 14, and 15 are screwed inwards thus bearing against the end surface of each guide ring 7. Subsequently, the centering of the sleeve 2 is measured, one end at a time, by means of a dial micrometer which is for instance placed above the sleeve 2. When the sleeve 2 during its rotation is in a position in which the maximum deflection is measured on the dial micrometer, the sleeve 2 is stopped and the two axial adjusting screws on the opposite side of the dial micrometer are screwed further into the guide ring 7. In this manner the guide ring 7 will take up an inclined position relative to the longitudinal axis of the sleeve 2. The conical guide surface 10 of the sleeve 2 will be displaced along the conical guide surface 9 of the guide ring 7 in such manner that the end of the sleeve 2 at the guide ring in question will move downwards and consequently reduce the deflection on the dial micrometer. The inaccuracy of the centering of the sleeve 2 is thus reduced accordingly.

As shown in FIG. 2 each adjusting screw 13, 14, and 15 is provided with a rounded end portion 22 of a relatively soft material, e.g. brazen material, at its threaded ends. As a result the threaded ends of the adjusting screws 13, 14, and 15 will not cause burrs or similar scratches when they bear against the end surface of the guide ring 7, said end being at the non-tapered end of the guide ring 7.

The securing means in the form of clamping screws 11 and 12 of each clamping ring 8 are in a plane at right angles to the longitudinal axis of the clamping ring 8, and they are adjustably screwed into threaded holes 23 and 24 (FIG. 3). These threaded holes 23 and 24 extend radially through the clamping rings 8 with a displacement of about 50° to 70°, especially 60°, relative to each other along the periphery of said clamping ring, when two clamping screws 11 and 12 are used as illustrated in FIG. 3. This provides an inexpensive and simple clamping ring 8 which, when utilizing two clamping screws 11 and 12, provides contact between the shaft 1 and each clamping ring 8 on three spots, i.e. at the threaded ends of the two clamping screws 11 and 12 and along a line diametrically opposite the clamping screws 11 and 12. Thus a safe and quick locking of each clamping ring 8 on the shaft 1 is achieved and consequently a safe mounting of the sleeve 2 on the shaft 1.

As shown in FIGS. 3 and 4 each radial threaded hole 23 and 24 on the inside 25 of the clamping ring 8 is provided with an axial recess 26 and 27 respectively in the form of a key slot, in which a thrust pad 28 and 29 respectively is situated. Since the threaded ends of the clamping screws 11 and 12 do not contact the surface of the shaft 1 directly, it is obtained, that the threaded ends of the clamping screws 11 and 12 will not cause burrs or similar scratches in the surface of the shaft 1. A further advantage of this arrangement is that a larger contact surface between the shaft 1 and each clamping ring 8 is obtained by means of the thrust pads 28 and 29.

The inner tubular cylinder 4 (FIG. 2) of the sleeve 2 is preferably made of metal, particularly steel. This implies that the conical and cylindrical guide surfaces 10 and 17 respectively of the sleeve 2 may be situated at the ends of the inner tubular cylinder 4 as shown in FIG. 2 and they may thus have the necessary hardness.

The conical guide surface 9 on each guide ring 7 forms an angle of about 20° to 60°, particularly 25°, with the longitudinal axis of the guide ring 7, and the conical guide surface 10 at each end of the sleeve 2 also forms an angle of about 20° to 60°, especially 25°, with the longitudinal axis of the sleeve 2. In this manner the projecting end of the inner tubular cylinder 4 relative to the outer tubular cylinder 5 will not be too tapered, which might imply that the projecting portion would easily break off due to bumps or impacts.

The outer tubular cylinder 5 of the sleeve 2 is preferably made of plastics, especially polyurethane or similar foamed materials. This reduces the total weight of the sleeve 2 at the same time as the outer tubular cylinder 5 damps vibrations.

The printing cylinder according to the invention may be used in printing machines, particularly but not exclusively in flexoprinting machines.

When a shaft 1 with a diameter of for instance 65 mm on the middle portion of the shaft 1 is used, the clearance between the shaft 1 and each guide ring 7 may advantageously be 0.1 to 0.2 mm. As a result of tests of such a shaft, where the distance between the supporting bearings on the shaft 1 was about 800 mm, it has been found that the sleeve 2 after precentering in several cases was centered with a relatively high accuracy relative to the shaft 1, i.e. with an accuracy of about 0.05 mm at each end of the sleeve 2.

Since each adjusting mechanism 3 is an individual portion that may be connected to and separated from the sleeve 2, the sleeve 2 is relatively inexpensive to manufacture in such manner that the printing block may be permanently secured to the sleeve 2 without necessitating a separation from the latter when it is to be stored. This is a time saving mounting and dismounting of the printing block, and the replacement of a printing cylinder does not necessitate a production stop of the printing cylinder.

The illustrated embodiment of the printing cylinder may be varied in many ways. It is for instance in some cases advantageous to make the shaft tubular and not solid as shown in FIG. 2. The cylindrical portion 6, that may be supported by a bearing, may for instance have the same diameter as the middle portion of the shaft 1 instead of being shouldered as shown in FIG. 2.

I claim:

1. A printing cylinder for printing machines, particularly flexoprinting machines and indirect photogravure printing machines, comprising a shaft (1), a sleeve (2) adapted to support a printing block and mounted on the shaft (1) with radial clearance, and two adjusting mechanisms (3), said adjusting mechanisms including a respective adjusting mechanism (3) provided at each end of said sleeve (2), each adjusting mechanism (3) being adapted to centre and secure the sleeve (2) on the shaft (1) and each comprising a guide ring (7) and a clamping ring (8), said guide ring (7) being provided with a circumferential conical guide surface (9) engageable with a corresponding circumferential conical guide surface (10) at each end of the sleeve (2), characterized in that a fit between the shaft (1) and the guide ring (7) is so easy that the guide ring (7) may be somewhat tilted relative to a plane at right angles to the longitudinal axis of the shaft (1), and that the clamping ring (8) comprises radial, adjustable securing means (11, 12) for securing said clamping ring to said shaft and axial adjusting means (13, 14, 15) for adjusting said guide ring.

2. A printing cylinder as claimed in claim 1, characterized in that the sleeve (2) on its inside at each end is provided with a circumferential cylindrical recess (17), such as a shoulder, bordering on the conical guide surface (10) of the sleeve (2), and which is adapted - by an easy fit - to cooperate with a cylindrical guide surface (18) shorter relative to the recess (17), said cylindrical guide surface (18) being situated on the outside of the tapered end of the guide ring (7).

3. A printing cylinder as claimed in claim 1, characterized by the conical guide surface (9) of each guide ring (7) forming an angle of about 20° to 60°, especially 25°, with the longitudinal axis of the guide ring (7), and by the conical guide surface (10) at each end of the sleeve (2) also forming an angle of about 20° to 60°, especially 25°, with the longitudinal axis of the sleeve (2).

4. A printing cylinder as claimed in claim 1, characterized by the fit between the shaft (1) and each guide ring (7) being a clearance fit.

5. A printing cylinder as claimed in claim 1, characterized by the number of axial adjusting means (13, 14, 15) of each clamping ring (8) being an uneven number.

6. A printing cylinder as claimed in claim 1, characterized by the axial adjusting means of each clamping ring (8) being adjusting screws (13, 14, 15) adjustably screwed into threaded holes (19, 20, 21), said holes extending axially through the clamping ring (8) with a preferably equal angular displacement, for example 120°, relative to each other along the periphery of the clamping ring (8), when three adjusting screws (13, 14, 15) are used.

7. A printing cylinder as claimed in claim 6, characterized by each adjusting screw (13, 14, 15) at its threaded end being provided with a rounded end portion (22) of relatively soft material, which is brazen material.

8. A printing cylinder as claimed in claim 1, characterized by the radial securing means of each clamping ring (8) being clamping screws (11, 12) disposed in a plane at right angles to the longitudinal axis of the clamping ring (8) and adjustably screwed into threaded holes (23, 24), said holes extending radially through the clamping ring (8) with a displacement of about 50° to 70°, especially 60°, relative to each other along the periphery of said clamping ring, when two clamping screws (11, 12) are used.

9. A printing cylinder as claimed in claim 8, characterized by each radial threaded hole (23, 24) on the inside of the clamping ring (8) being provided with an axial recess (26, 27) in which a thrust pad (28, 29) is arranged.

10. A printing cylinder as claimed in claim 1, characterized by the sleeve (2) comprising an inner tubular cylinder (4) of metal, especially steel, and an outer tubular cylinder (5) of plastics, especially polyurethane or similar foamed material, said outer tubular cylinder (5) being situated on the outside of the inner tubular cylinder (4).

* * * * *